US010207884B2

(12) United States Patent
Kamikawa et al.

(10) Patent No.: US 10,207,884 B2
(45) Date of Patent: Feb. 19, 2019

(54) IMAGE FORMING APPARATUS

(71) Applicant: Brother Kogyo Kabushiki Kaisha, Nagoya (JP)

(72) Inventors: Kazuya Kamikawa, Nagakute (JP); Shoichiro Nishimura, Ama-gun (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/887,003

(22) Filed: Feb. 2, 2018

(65) Prior Publication Data

US 2018/0282092 A1 Oct. 4, 2018

(30) Foreign Application Priority Data

Mar. 31, 2017 (JP) ..... 2017-073305

(51) Int. Cl.

| | |
|---|---|
| ***B65H 9/16*** | (2006.01) |
| ***B65H 5/36*** | (2006.01) |
| ***B65H 1/04*** | (2006.01) |
| ***B65H 29/20*** | (2006.01) |
| ***B65H 5/06*** | (2006.01) |

(52) U.S. Cl.

CPC ..... *B65H 9/166* (2013.01); *B65H 1/04* (2013.01); *B65H 5/062* (2013.01); *B65H 5/36* (2013.01); *B65H 29/20* (2013.01); *B65H 2301/331* (2013.01); *B65H 2801/09* (2013.01)

(58) Field of Classification Search

CPC ..... B65H 9/166; B65H 5/36; B65H 5/062; B65H 29/20; B65H 29/52

USPC ..... 271/251

See application file for complete search history.

(56) References Cited

U.S. PATENT DOCUMENTS

| | | | | |
|---|---|---|---|---|
| 7,571,908 | B2 * | 8/2009 | Inui | B65H 9/166 271/251 |
| 8,534,668 | B2 * | 9/2013 | Iino | B65H 5/062 271/186 |
| 8,684,354 | B2 * | 4/2014 | Iino | B65H 1/266 271/186 |

(Continued)

FOREIGN PATENT DOCUMENTS

| | | |
|---|---|---|
| JP | H02-132049 U | 11/1990 |
| JP | 2005-263343 A | 9/2005 |

(Continued)

*Primary Examiner* — David H Bollinger

(74) *Attorney, Agent, or Firm* — Burr & Brown, PLLC

(57) ABSTRACT

An image forming apparatus, including a reference guide, an oblique conveyer roller, and a curve guide, is provided. The reference guide is arranged on one side in a widthwise direction with respect to a widthwise center in a sheet conveyer path and regulates a widthwise position of the sheet. The oblique conveyer roller applies a conveying force acting in a direction toward downstream along a conveying direction and toward the reference guide to the sheet. The curve guide is arranged upstream with respect to the oblique conveyer roller along the conveying direction and forms a curve. The curve guide includes an inner guide and an outer guide. The outer guide has a constant curvature throughout a width regardless of a widthwise position therein. The inner guide has a protrusive portion protruding toward the outer guide at a position on the other side in the widthwise direction with respect to the widthwise center.

7 Claims, 7 Drawing Sheets

(56) References Cited

U.S. PATENT DOCUMENTS

| | | | | |
|---|---|---|---|---|
| 8,695,974 | B2 * | 4/2014 | Iino | B41J 3/60 271/248 |
| 8,746,693 | B2 * | 6/2014 | Miyazawa | B65H 85/00 271/227 |
| 8,764,008 | B2 * | 7/2014 | Otsuki | B41J 3/60 271/227 |
| 8,789,828 | B2 * | 7/2014 | Wang | G07D 11/0027 271/251 |
| 2007/0023995 | A1 * | 2/2007 | Onodera | B65H 9/006 271/226 |
| 2007/0273092 | A1 * | 11/2007 | Inui | B65H 9/166 271/251 |

FOREIGN PATENT DOCUMENTS

| | | | |
|---|---|---|---|
| JP | 2006-016189 | A | 1/2006 |
| JP | 2006-111364 | A | 4/2006 |
| JP | 2007-091418 | A | 4/2007 |

* cited by examiner

IMAGE FORMING APPARATUS

CROSS REFERENCE TO RELATED APPLICATION

This application claims priority from Japanese Patent Application No. 2017-073305, filed on Mar. 31, 2017, the entire subject matter of which is incorporated herein by reference.

BACKGROUND

Technical Field

An aspect of the present disclosure is related to an image forming apparatus.

Related Art

An image forming apparatus capable of double-face printing, or duplex printing, i.e., forming images on both sides of a sheet, is known. The image forming apparatus may have a duplex conveyer. When an image is to be formed solely on one side of a sheet, the sheet may be conveyed from a feeder tray to an image forming device, in which the image is formed on the sheet, and the sheet with the image formed thereon may be ejected outward at an ejection tray without being conveyed to the duplex conveyer. When images are to be formed on both sides of a sheet, the sheet may be conveyed from the feeder tray to the image forming device, in which an image may be formed on one side of the sheet, and the sheet with the image formed on the one side may be conveyed to the duplex conveyer. As the sheet is conveyed in the duplex conveyer, the sheet may be inverted, and the inverted sheet may be conveyed again to the image forming device with the other side facing toward the image forming device. The image forming device may form another image on the other side of the sheet, and the sheet may be thereafter ejected outward at the ejection tray.

The duplex conveyer may have an oblique conveyer roller, at a position displaced from a widthwise center of the duplex conveyer, to convey the sheet in a conveying direction and shift the sheet sideward in a widthwise direction. Meanwhile, at a position on one widthwise side of the oblique conveyer roller in the duplex conveyer, arranged may be a reference guide to correct a widthwise position of the sheet being conveyed in the duplex conveyer. Therefore, while the oblique conveyer roller is arranged at the position displaced from the widthwise center of the duplex conveyer, at the beginning when the sheet is caught by the oblique conveyer roller, the oblique conveyer roller may thrust the sheet at the widthwise displaced position, and the sheet may incline in such an orientation that a widthwise half of a leading edge of the sheet on the side of the oblique conveyer roller may precede the other widthwise half of the leading edge of the sheet. As the sheet is conveyed further in this inclined orientation, a sideward edge of the sheet on the one widthwise side may contact the reference guide, and the sheet may be turned by the contact with the reference guide in such a direction that the leading edge may be oriented toward the reference guide. Thus, the sideward edge of the sheet may align along the reference guide, and the sheet may be placed at the widthwise correct position.

In this regard, at the beginning when the sheet enters the duplex conveyer, if the sheet is initially in such an inclined orientation that the other widthwise half of the leading edge, on the side that is not thrusted by the oblique conveyer roller, largely precedes the one widthwise half of the leading edge on the side of the oblique conveyer roller, the sheet may not be completely turned to the orientation, in which the sideward edge reaches the reference guide, while conveyance of the sheet in the conveying direction may be completed. In order to retrain the incomplete turn of the sheet, for example, a sheet conveyer path to convey the sheet may be curved at a section upstream with respect to the oblique conveyer roller, and a curve guide to form the curved section may be in such a structure that lengths along the conveying direction are differed within a width of the sheet conveyer path. In other words, in a curve guide at a curved section arranged in a range upstream with respect to the oblique conveyer roller in a sheet conveyer path, the sheet conveyer path may be longer at one widthwise end and may be shorter at the other widthwise end.

SUMMARY

In the curved section having different sheet conveying lengths within the width, the leading edge of the sheet conveyed in the curved section may reach a predetermined part in the curve guide at different timings depending on the widthwise position in the leading edge. In other words, a part of the leading edge in the widthwise direction conveyed through the curved section having a shorter distance may reach the predetermined part earlier, and the another part of the leading edge conveyed through the curved section having a longer distance may reach the predetermined part later. With this time lag, the part of the sheet that may reach the predetermined part earlier may collide with the predetermined part to produce conveying resistance, and the sheet being subjected to the conveying resistance may be jammed thereat.

The present disclosure is advantageous in that an image forming apparatus, in which performance of an oblique conveyer roller, specifically, accuracy in correcting a widthwise position of a sheet, may be improved, is provided.

According to an aspect of the present disclosure, an image forming apparatus, including a reference guide, an oblique conveyer roller, and a curve guide, is provided. The reference guide is arranged on one side in a widthwise direction with respect to a widthwise center in a sheet conveyer path. The widthwise direction is orthogonal to a conveying direction to convey a sheet in the sheet conveyer path. The reference guide is configured to regulate a position of the sheet in the widthwise direction. The oblique conveyer roller is configured to apply a conveying force acting in a direction toward downstream along the conveying direction and toward the reference guide to the sheet. The curve guide is arranged upstream with respect to the oblique conveyer roller along the conveying direction. The curve guide forms a curve, along which the sheet is curved and guided. The curve guide includes an inner guide forming an inner side of the curve and an outer guide forming an outer side of the curve. The outer guide has a constant curvature throughout a width regardless of a widthwise position therein. The inner guide includes a protrusive portion protruding toward the outer guide at a position on the other side in the widthwise direction with respect to the widthwise center.

BRIEF DESCRIPTION OF THE ACCOMPANYING DRAWINGS

Figure 6A:
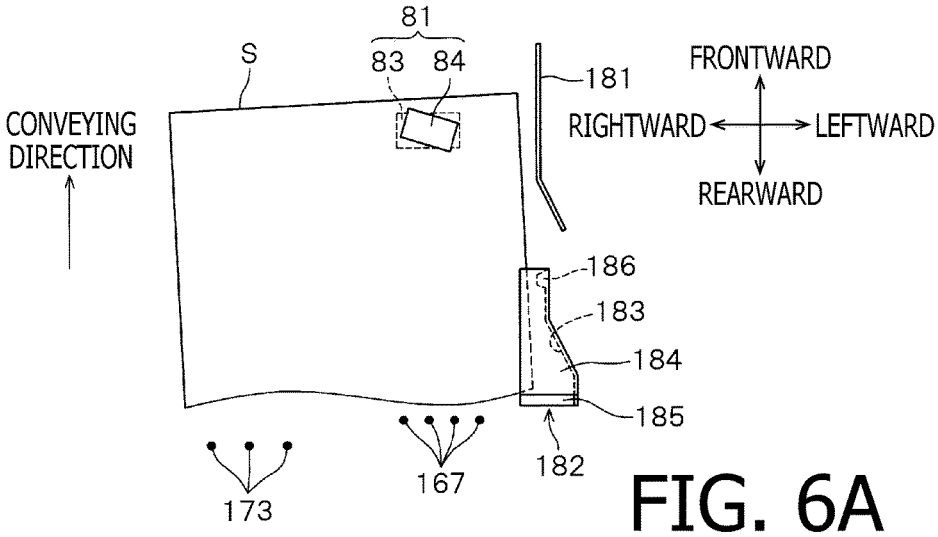
Figure 6B:
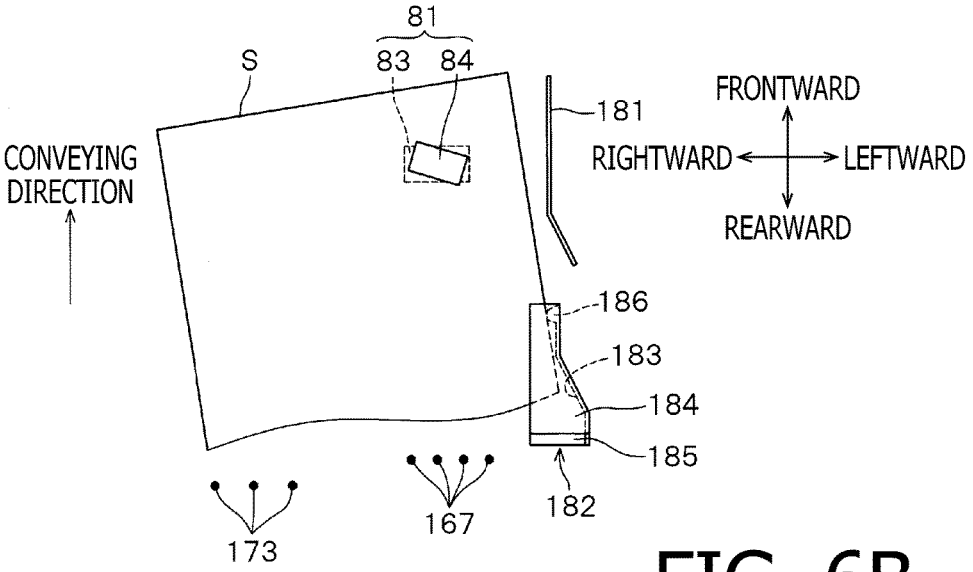
Figure 6C:
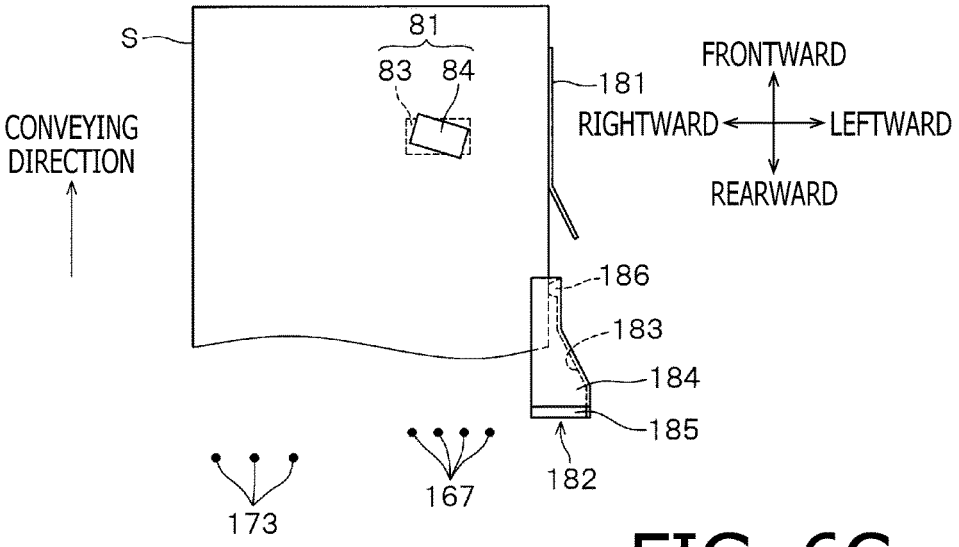

FIG. 6A illustrates arrangement of a reference guide and a directing guide in the image forming apparatus according to the embodiment of the present disclosure, with a sheet being caught in a first inverting conveyer roller pair. FIG. 6B illustrates arrangement of the reference guide and the directing guide in the image forming apparatus according to the embodiment of the present disclosure, with the sheet contacting the directing guide. FIG. 6C illustrates arrangement of the reference guide and the directing guide in the image forming apparatus according to the embodiment of the present disclosure, with the sheet in a correct widthwise position.

Figure 7:
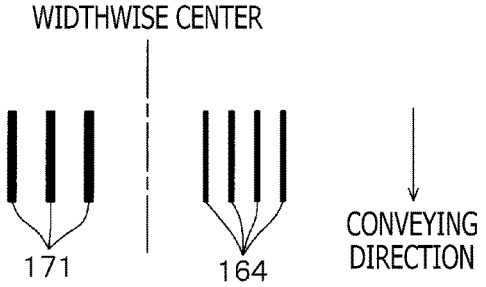

FIG. 7 illustrates another example of the curve guide in the image forming apparatus according to the embodiment of the present disclosure.

Figure 8:
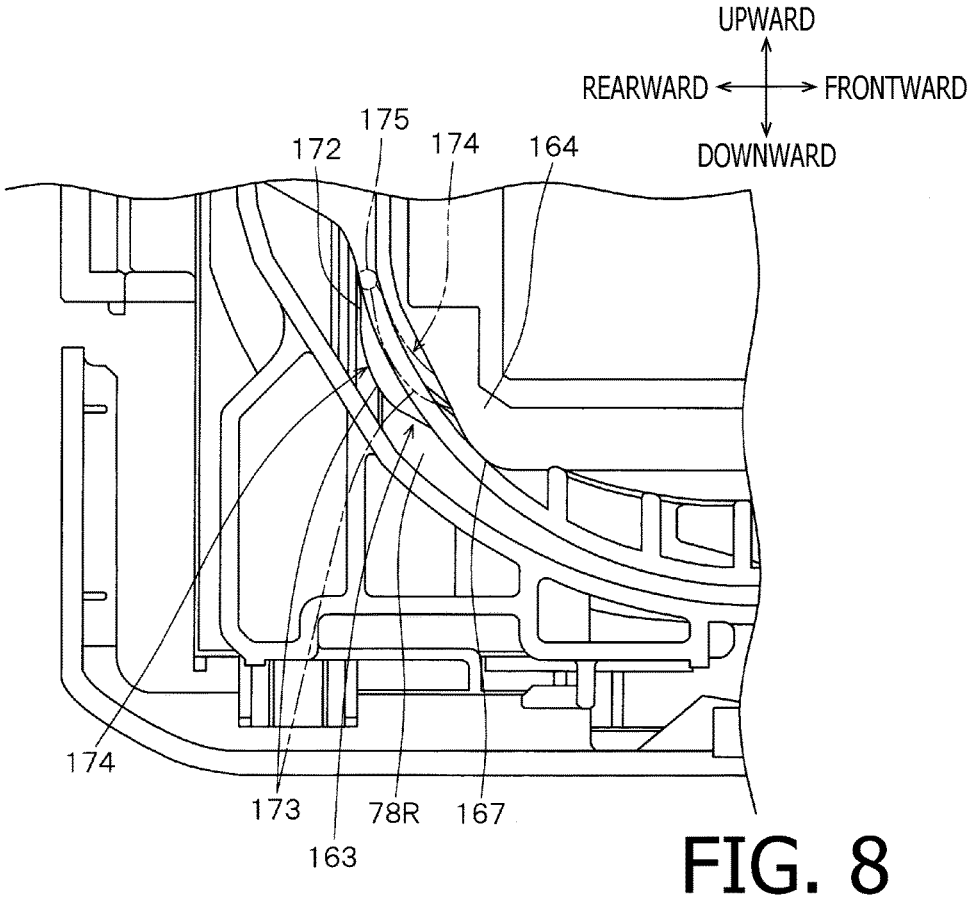

FIG. 8 is a cross-sectional view of another example of the curve guide in the image forming apparatus according to the embodiment of the present disclosure.

DETAILED DESCRIPTION

Hereinafter, an embodiment of the present disclosure will be described with reference to the accompanying drawings.

<Exterior Configuration of Printer>

Figure 1:
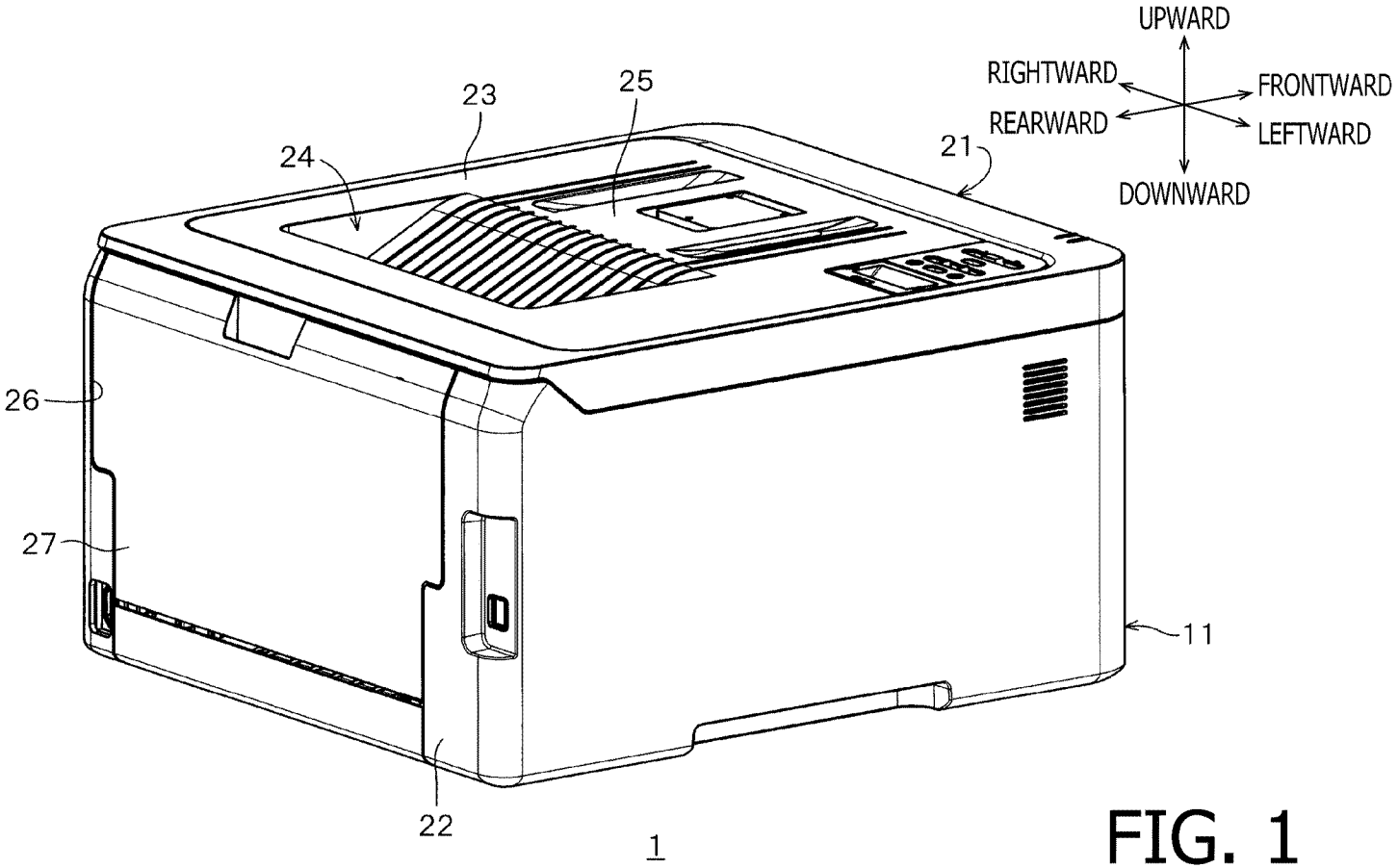
FIG. 1 is a perspective view of an image forming apparatus according to an embodiment of the present disclosure.
Figure 2:
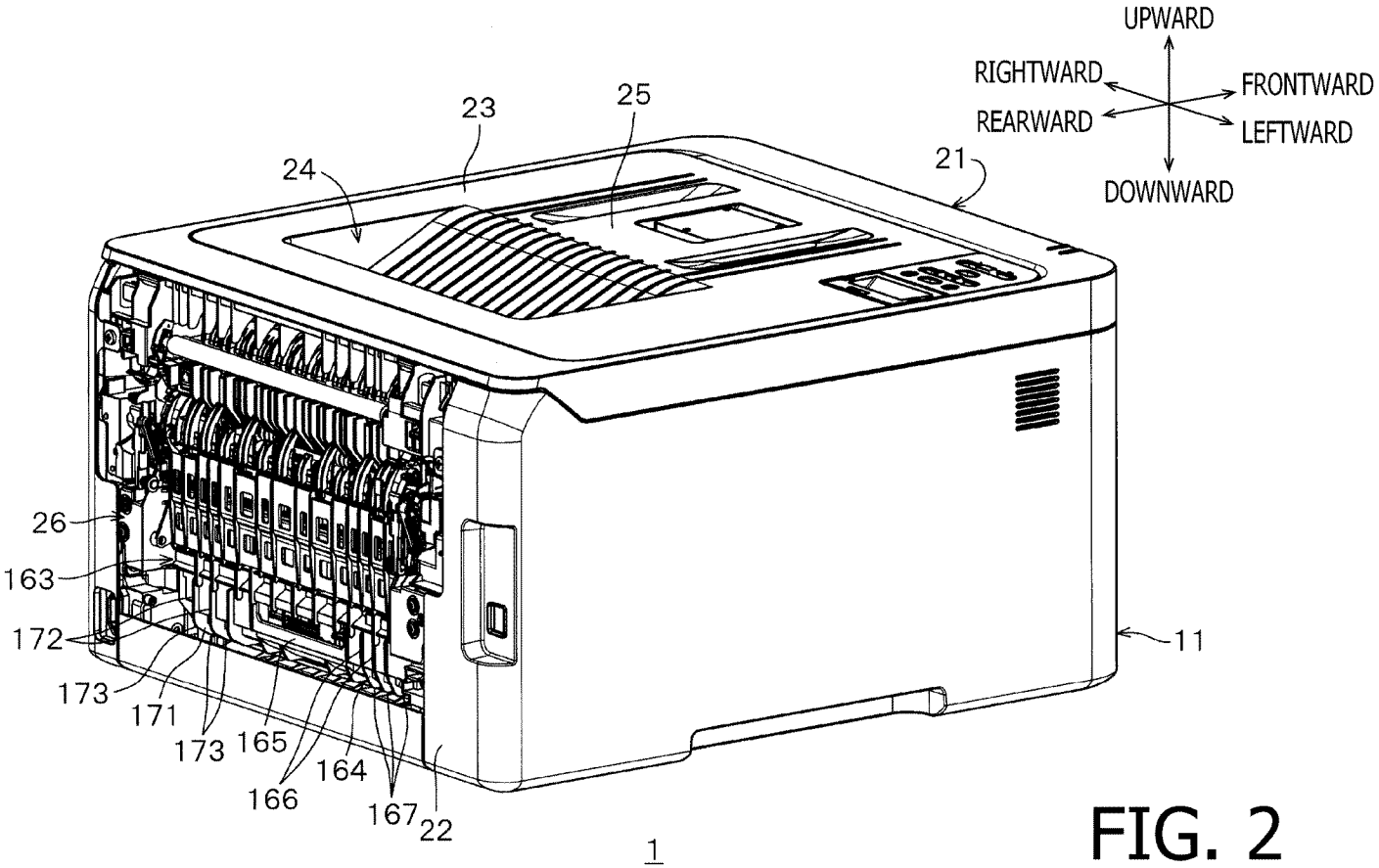
FIG. 2 is a perspective view of the image forming apparatus, with a maintenance cover being removed, according to the embodiment of the present disclosure.

A printer 1, as shown in FIGS. 1-2, includes a body 11. The body 11 has a first side surface 21 (see FIG. 3) and a second side surface 22, which face each other at spaced apart positions. When the printer 1 is placed on a horizontal plane, the first side surface 21 and the second side surface 22 may stand substantially vertically to the horizontal plane. The body 11 includes an upper surface 23, which spreads between upper ends of the first side surface 21 and the second side surface 22. The upper surface 23 includes a dent 24, which dents downward. An area inside the dent 24 and an area closer to the first side surface 21 on the upper surface 23 form an ejection tray 25.

In the following description, directions related the printer 1 and each part or item included in the printer 1 will be mentioned on basis of directions indicated by arrows in each drawing. For example, a side, on which the first side surface 21 is arranged, may be referred to a frontward side. A direction, along which the first side surface 21 and the second side surface 22 face each other, may be referred to as a front-rear direction. A user may face the first side surface 21 in order to ordinarily use the printer 1, and the user's right-hand side and left-hand side may be referred to a rightward side and a leftward side, respectively, and a left-to-right or right-to-left direction may be referred to as a widthwise direction. An up-to-down or down-to-up direction may be referred to as a vertical direction.

On the second side surface 22, as shown in FIG. 2, formed is an opening portion 26. Over the opening portion 26, arranged is a maintenance cover 27 (see FIG. 1), which is openable/closable to expose or close the opening portion 26. With the maintenance cover 26 placed over the opening portion 26, as shown in FIG. 1, the opening portion 26 may be closed by the maintenance cover 27, and when the maintenance cover 26 swings open, an inner guide 163, which will be described later in detail, may be exposed (see FIG. 2). In FIG. 2, illustration of the maintenance cover 27 is omitted.

<Interior Configuration of the Printer>

Figure 3:
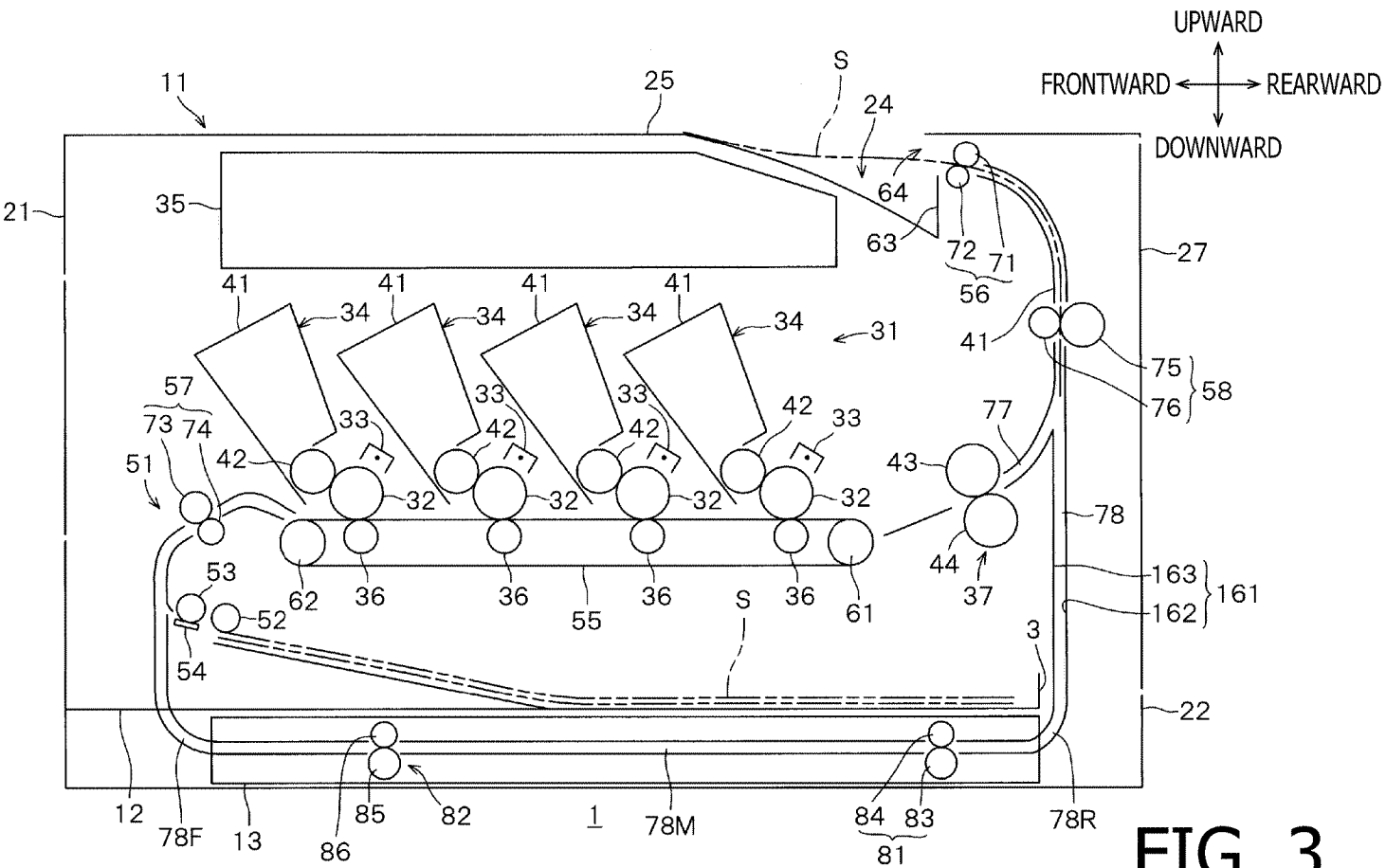
FIG. 3 is a cross-sectional view of the image forming apparatus according to the embodiment of the present disclosure.

The printer 1 may be, as shown in FIG. 3, but not necessarily be limited to, a color laser printer. Optionally, the printer 1 may be a monochrome laser printer or may be an inkjet printer to form an image on a sheet S in an inkjet-printing technic.

At lower positions inside the body 11, arranged are a feeder tray 12 and a duplex conveyer 13, which overlap each other vertically.

Inside the body 11, further, arranged is an image forming device 31, which may form an image on the sheet S in an electro-photographic technic. The image forming device 31 may include four (4) photosensitive drums 32, four (4) chargers 33, four (4) developer devices, an exposure device 35, four (4) transfer rollers 36, and a fuser 37.

The photosensitive drums 32 are for forming images in different colors, e.g., black (K), yellow (Y), magenta (M), and cyan (C) and may be arranged in this mentioned order from upstream to downstream along the front-rear direction to convey the sheet P at upper positions with respect to the feeder tray 12 to be spaced apart evenly from one another. The photosensitive drums 32 are rotatable about respective rotation axes, which extend in the widthwise direction.

The chargers 33 are respectively provided to corresponding one of the photosensitive drums 32, and each charger 33 is arranged at an upper-rearward position of the corresponding photosensitive drum 32. The chargers 33 may be, for example, scorotron chargers each having a wire and a grid.

The developer devices 34 are respectively provided to corresponding one of the photosensitive drums 32, and each developer device 34 is arranged at an upper-frontward position of the corresponding photosensitive drum 32. Each developer device 34 includes a developer housing 41 to contain toner and a developer roller 42 held by the developer housing 41. The developer roller 42 is rotatable about an axis, which extends in the widthwise direction. A circumferential surface of the developer roller 49 contacts a circumferential surface of the corresponding photosensitive drum 32.

The exposure device 35 is arranged at an upper position with respect to the chargers 33 and the developer devices 34. The exposure device 35 includes an optical system, including a laser emitter and polygon mirrors, to emit laser beams at the photosensitive drums 32 according to image data.

The transfer rollers 36 are each arranged at a lower position with respect to the corresponding one of the photosensitive drums 32. The transfer rollers 36 are rotatable about respective axes, which extend in the widthwise direction.

The fuser 37 is arranged at a rearward position with respect to the photosensitive drum 32 at the most rearward position. The fuser 37 includes a heating roller 43 and a pressing roller 44. The heating roller 43 is rotatable about an axis, which extends in the widthwise direction. The pressing roller 44 is arranged at a lower-rearward position with respect to the heating roller 43 and is rotatable about an axis, which extends in the widthwise direction. A circumferential surface of the pressing roller 44 contacts a circumferential surface of the heating roller 43.

Inside the body 11, further, arranged is a sheet conveyer 51 to convey the sheet S in a conveying direction, which may be in parallel with the front-rear direction and orthogonal to the widthwise direction. The sheet conveyer 51 includes a feeder roller 52, a separator roller 53, a separator pad 54, a conveyer belt 55, an ejection roller pair 56, a first conveyer roller pair 57, and a second conveyer roller pair 58.

The feeder roller 52 is arranged at an upper position with respect to a frontward end of the feeder tray 12. The feeder roller 52 is in an arrangement such that a circumferential surface of the feeder roller 52 may contact an upper-side surface of a topmost sheet S in the stack of sheets S supported on the feeder tray 12.

The separator roller 53 and the separator pad 54 are arranged at frontward positions with respect to the feeder roller 52. The separator roller 53 is rotatable about a rotation axis, which extends in the widthwise direction. The separator pad 54 may contact a circumferential surface of the separator roller 53 at a lower-frontward position with respect to the separator roller 53.

The conveyer belt 55 is arranged at a lower position with respect to the photosensitive drums 32. The conveyer belt 55 is an endless belt strained around rollers 61, 62. The rollers 61, 62 are arranged at a same height and spaced apart in the front-rear direction from each other. The conveyer belt 55 has flat areas, which overlap each other vertically and spread in the front-rear and widthwise directions, in a range between the rollers 61, 62. An upper one of the flat areas of the conveyer belt 55 extends between the photosensitive drums 32 and the transfer rollers 36 and contacts circumferential surfaces of the photosensitive drums 32 on one side and circumferential surfaces of the transfer roller 36 on the other side.

The body 11 includes a wall surface 63, which stands upward at a rearward end of the dent 24 formed on the upper surface 23. In the wall surface 63, formed is a sheet outlet 64, through which the sheet S may be ejected at the ejection tray 25. The ejection roller pair 56 is arranged at a rearward position with respect to the sheet outlet 64. The ejection roller pair 56 includes a pair of rollers, which are a driving roller 71 and a driven rollers 72. The driving roller 71 and the driven roller 72 are arranged to contact each other at circumferential surfaces and are rotatable about respective rotation axes thereof, which extend in the widthwise direction. A contact area between the circumferential surfaces of the driving roller 71 and the driven roller 72 is located at a rearward position with respect to the sheet outlet 64.

The first conveyer roller pair 57 is arranged at an upper position with respect to the separator roller 53 and a frontward position with respect to the conveyer belt 55. The first conveyer roller pair 53 includes a pair of rollers, which are a driving roller 73 and a driven roller 74. The driving roller 73 and the driven roller 74 are arranged to contact each other at circumferential surfaces and are rotatable about respective axes thereof, which extend in the widthwise direction.

The second conveyer roller pair 58 is arranged at an upper-rearward position with respect to the fuser 37. The second conveyer roller pair 58 includes a pair of rollers, which are a driving roller 75 and a driven roller 76. The driving roller 75 and the driven roller 76 are arranged to contact each other at circumferential surfaces thereof and are rotatable about respective axes thereof, which extend in the widthwise direction.

In order to print an image on a sheet S, the sheet conveyer 51 may operate to convey the sheet S, and the image forming device 31 may form an image on the sheet S being conveyed.

In order to convey the sheet S from the feeder tray 12, the feeder roller 52 may rotate clockwise in a view from the right (see FIG. 3). As the feeder roller 52 rotates, the sheet S being in contact with the circumferential surface of the feeder roller 52, i.e., a topmost sheet S in the stack of sheets S supported on the feeder tray 12, is conveyed frontward. The sheet S from the feeder tray 12 is forwarded through the position between the separator roller 53 and the separator pad 53 to be separated from other sheets S in the stack.

The sheet S traveling through the position between the separator roller 53 and the separator pad 54 is conveyed to a position on the conveyer belt 55, which may circulate clockwise in the view from the right. The sheet S conveyed to the conveyer belt 55 moves along with the upper flat area in the conveyer belt 55 to pass through the positions between the photosensitive drums 32 and the conveyer belt 55.

The photosensitive drums 32 may rotate counterclockwise in the view from the right. As the photosensitive drums 32 rotate, the surfaces of the photosensitive drums 32 are charged evenly by the chargers 33 and selectively exposed to the laser beams from the exposure device 35. Potential in areas on the surfaces of the photosensitive drums 32 exposed to the laser beams is lowered to form electrostatic latent images on the surfaces of the photosensitive drums 32. Thereafter, positively charged toner is supplied by the developer rollers 42 to the electrostatic latent images on the surfaces of the photosensitive drums 32 so that the electrostatic images are developed to be toner images and carried on the surfaces of the photosensitive drums 32.

Meanwhile, transfer bias is applied to the transfer rollers 36. In order to form a monochrome image on the sheet S, a toner image is formed on a surface of the photosensitive drum 32 corresponding to the developer device 34 containing black toner. As the sheet S proceeds through the position between the photosensitive drum 32 and the transfer roller 36, the toner image in black may be transferred from the surface of the photosensitive drum 32 to an upper side of the sheet S due to an effect of the transfer bias. In order to form a colored image, toner images formed on the surfaces of the photosensitive drums 32 corresponding to the developer devices 34 containing black, yellow, cyan, and magenta toners are transferred in layers onto the upper side of the sheet S due to the effect of the transfer bias.

The sheet S with the toner images transferred thereon may proceed further rearward to enter the fuser 37. In the fuser 37, the sheet S proceeds through the position between the heating roller 43 and the pressing roller 44 while the toner images are fixed onto the sheet S. With the heat and the pressure applied thereto, forming the image on a first side of the sheet S may be completed.

The printer 1 may perform single-face printing, in which an image may be formed solely on the first side of the sheet S, and duplex printing, in which images may be formed on both the first side and a second side of the sheet S.

In a single-face printing operation, the sheet S with the image formed on the first side is conveyed by the second conveyer roller pair 58 and the ejection roller pair 56 to be ejected outside the body 11 through the sheet outlet 64 to rest on the ejection tray 25. Thus, the sheet S conveyed from the feeder tray 12 may travel in the conveyer path 77 through the position between the separator roller 53 and the separator pad 54, the positions between the photosensitive drums 32 and the conveyer belt 55, the position between the heating roller 43 and the pressing roller 44 in the fuser 37, the position between the driving roller 75 and the driven roller 76 in the second conveyer roller pair 58, and the position between the driving roller 71 and the driven roller 75 in the ejection roller pair 56, sequentially, to the ejection tray 25.

In order to enable a duplex printing operation, the printer 1 has an inverting conveyer path 78. The inverting conveyer path 78 branches off from the conveyer path 77 at a position between the second conveyer roller pair 58 and the ejection roller pair 56, extends downward at a rearward area in the body 11, curves frontward at a position rearward with respect to the duplex conveyer 13, which is arranged at a position lower than the feeder tray 12, to extend frontward in the duplex conveyer 13, curves upward at a position frontward with respect to the duplex conveyer 13, and merges with the conveyer path 77 at a position between the separator roller 53 and the first conveyer roller pair 57.

The duplex conveyer 13 includes a section 78M, which extends in the front-rear direction, in the inverting conveyer path 78. The inverting conveyer path 78 includes a curved section 78F, which extends frontward and curves upward at a position frontward with respect to the duplex conveyer 13, and a curved section 78R, which extends downward and curves frontward at a position rearward with respect to the duplex conveyer 13. In the duplex conveyer 13, arranged are a first inverting conveyer roller pair 81 and a second inverting conveyer path 82.

The first inverting roller pair 81 includes a pair of roller, which are a driving roller 83 and a driven roller 84. The driving roller 83 and the driven roller 84 are arranged to contact each other at circumferential surfaces and are rotatable about respective axes thereof, which extend in the widthwise direction.

The second inverting roller pair 82, arranged frontward with respect to the first inverting roller pair 81, includes a pair of rollers, which are a driving roller 85 and a driven roller 86. The driving roller 85 and the driven roller 86 are arranged to contact each other at circumferential surfaces and are rotatable about respective axes thereof, which extend in the widthwise direction.

In a duplex printing operation, the sheet S with the image formed on the first side is conveyed in a reverse direction by the ejection roller pair 56 and the second conveyer roller pair 58 rotating in an opposite direction to be directed to the inverting conveyer path 78 without being ejected at the ejection tray 25. The sheet S directed to the inverting conveyer path 78 may be conveyed in the inverting conveyer path 78 frontward by the first inverting conveyer roller pair 81 and the second inverting conveyer roller pair 82 to the conveyer path 77. The sheet S conveyed through the inverting conveyer path 78 is inverted upside down so that the sheet S may be conveyed in the conveyer path 77 with the second side, on which no image is yet formed, facing toward the photosensitive drums 32. The inverted sheet S proceeds in the conveyer path 77 toward the photosensitive drums 32 so that another image may be formed on the second side of the sheet S, in the same manner as the image was formed on the first side of the sheet S. The sheet S with the images formed on the first and second sides is conveyed by the second conveyer roller pair 58 and the ejection roller pair 56 and ejected through the sheet outlet 64 to be released in the ejection tray 25.

<Duplex Conveyer>

Figure 4:
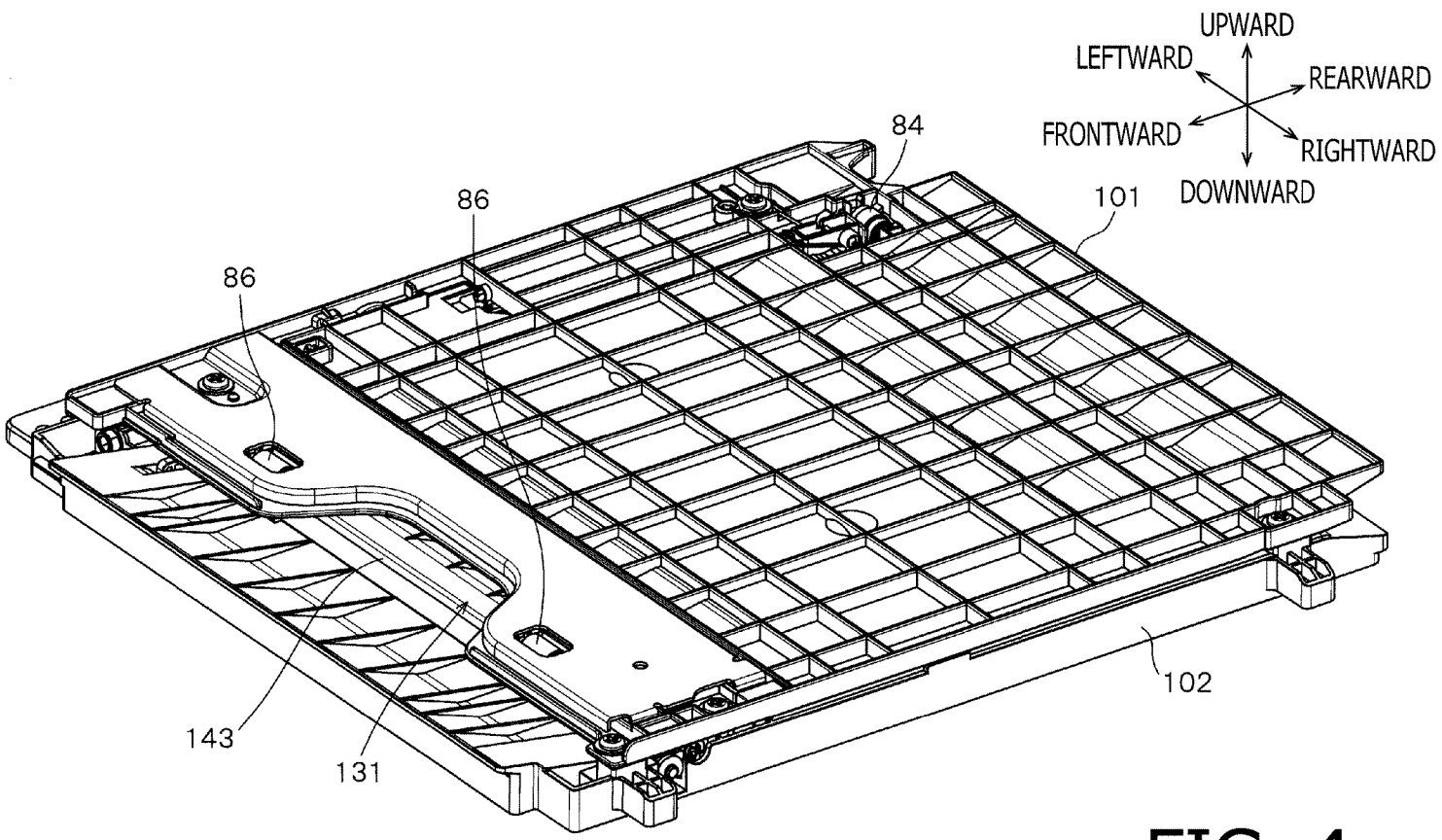
FIG. 4 is a perspective view of a duplex conveyer in the image forming apparatus according to the embodiment of the present disclosure.

The duplex conveyer 13 includes, as shown in FIG. 4, an upper guide 101 and a lower guide 102.

The upper guide 101 is made of resin and formed in an approximate shape of a rectangular plate, which spreads in the front-rear and widthwise directions. The upper guide 101 rotatably supports the driven roller 84 in the first inverting conveyer roller pair 81 and the driven roller 86 in the second inverting conveyer roller pair 82.

The driven roller 84 is arranged at a rear-leftward position in the upper guide 101. The driven roller 84 may be, for example, attached around a circumferential surface of a resin-made shaft or may be formed integrally with a shaft. The shaft of the driven roller 84 is arranged to incline with respect to the front-rear direction to be closer to the front at the rightward side and farther from the front at the leftward side. Due to this oblique arrangement, the driven roller 84 may apply an oblique conveying force, which may act in a frontward direction being downstream along the conveying direction and a leftward direction, to the sheet S. Thus, the first inverting conveyer roller pair 81, including the driven roller 84, may shift and convey the sheet leftward and frontward.

The driven roller 86 in the second inverting conveyer roller pair 82 includes two (2) driven rollers 86. The driven rollers 86 are arranged to be spaced apart from each other aligning along the widthwise direction at a front-end area, which is an area closer to the first side surface 21 rather than the second side surface 22, in the upper guide 101. The driven rollers 86 are rotatable about a common rotation axis, which extends in the widthwise direction.

The upper guide 101 includes a recessed portion 131 at a position between the two driven rollers 86. The recessed portion 131 is recessed rearward from a frontward end of the upper guide 101 to a position beyond the common rotation axis of the driven rollers 86. The recessed portion 131 is formed in a shape to be open wider at the front and recede narrower at the rear.

The lower guide 102 is made of resin and formed in an approximate shape of a rectangular plate, which spreads in the front-rear direction and the widthwise direction. A dimension of the lower guide 102 in the widthwise direction is equal to a dimension of the upper guide 101 in the widthwise direction. A dimension of the lower guide 102 in the front-rear direction is larger than a dimension of the upper guide 101 in the front-rear direction. A rearward edge of the lower guide 102 vertically overlaps a rearward edge of the upper guide 101 while a frontward edge of the lower guide 102 is located frontward with respect to the frontward edge of the upper guide 101.

The lower guide 102 rotatably supports, although not shown in FIG. 4, the driving roller 83 in the first inverting conveyer roller pair 81 and the driving roller 85 in the second inverting conveyer roller pair 82.

The driving roller 83 is a rubber roller in a cylindrical shape attached around a circumference of a resin-made shaft. As shown in FIG. 4, the driving roller 83 is arranged at a lower position with respect to the driven roller 84 in the first inverting conveyer roller pair 81. A circumferential surface of the driving roller 83 contacts a lower part of a circumferential surface of the driven roller 84.

While the driven roller 86 in the second inverting conveyer roller pair 82 includes two (2) driven rollers 86, the driving roller 85 in the second inverting conveyer roller pair 82 includes two (2) driving rollers 85 as well. The driving rollers 85 are rubber rollers in a cylindrical shape attached around a circumference of a common driving shaft 143 to rotate along with the driving shaft 143. The driving rollers 85 are arranged at lower positions with respect to the respective driven rollers 86. Therefore, the driving shaft 143 extends in the widthwise direction at a vertically lower position with respect to the shaft 105 of the driven rollers 86 at a same position in the front-rear direction as the shaft 105 of the driven rollers 86 and is exposed upward through the recessed portion 131 in the upper guide 101.

<Curve Guide>

The curved section 78R in the inverting conveyer path 78 is in a rearward range with respect to the duplex conveyer 13 and is formed by a curve guide 161 (see FIG. 3). The curve guide 161 curves lower-frontward from an upper-rearward position so that directions of the sheet S to be conveyed in the curved section 78R may be turned from a vertical direction to a horizontal direction. In other words, the curve guide 161 curves between the rearward section in the conveyer path 78 extending vertically and the horizontal section 78M in the conveyer path 78. The curve guide 161 includes an outer guide 162, which is arranged on an outer side of the curve, and an inner guide 163, which is arranged on an inner side of the curve (see FIG. 5).

The outer guide 162 is in such a form that a surface thereof that faces toward the inverting conveyer path 78, i.e., an inward surface, is curved at a constant curvature throughout a width so that a length along the curve is equal regardless of a widthwise position, and the inward surface of the outer guide 162 has substantially no convex or concave spot throughout the width.

Figure 5:
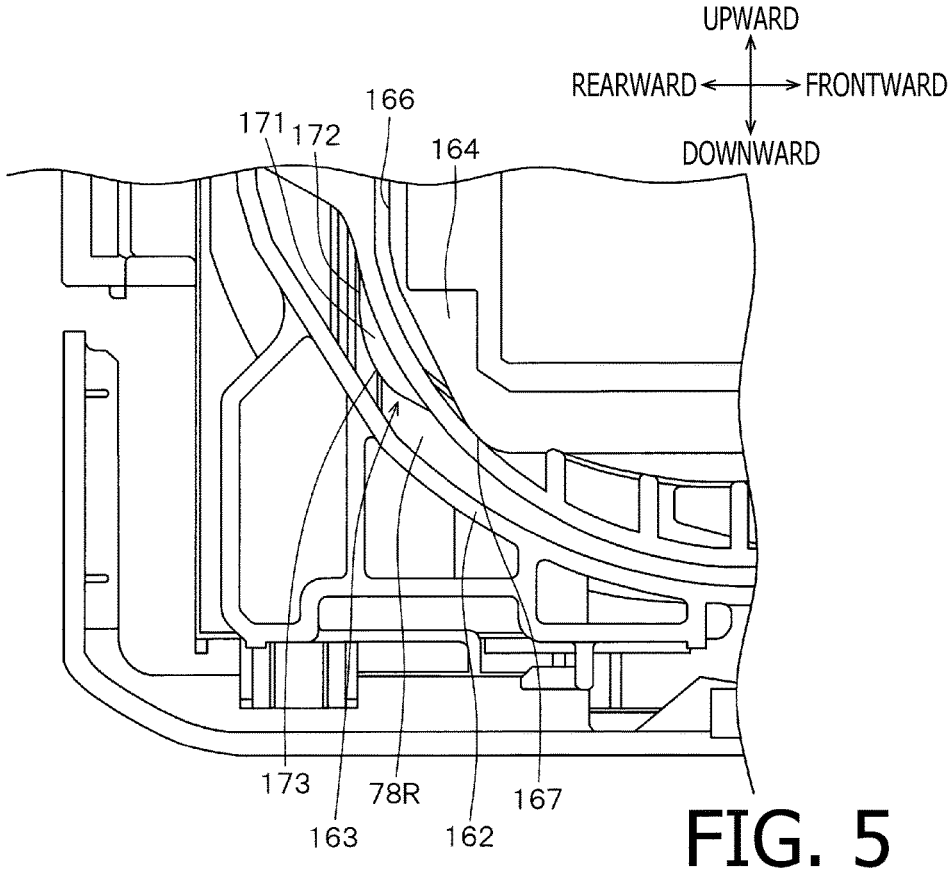
FIG. 5 is a cross-sectional view of a curve guide in the image forming apparatus according to the embodiment of the present disclosure.

The inner guide 163 includes, as shown in FIG. 2, a plurality of first ribs 164 in a leftward area with respect to a widthwise center of the inner guide 163. The first ribs 164 are spaced apart along the widthwise direction from one another and are formed to protrude rearward at the inverting conveyer path 78 from a rearward surface 165 of the inner guide 163 and elongated along the conveying direction. Edges of the first ribs 164 each includes, as shown in FIG. 5, a linear portion 166, which extends vertically, and a first bent portion 166, which bends or curves frontward from a lower end of the linear portion 166.

The inner guide 163 further includes, as shown in FIG. 2, a plurality of second ribs 171 in a rightward area with respect to the widthwise center. The second ribs 171 are spaced apart along the widthwise direction from one another and are formed to protrude rearward at the inverting conveyer path 78 from the rearward surface 165 of the inner guide 163 and elongated along the conveying direction. Edges of the second ribs 171 each includes, as shown in FIG. 5, a linear portion 172, which extends vertically, and a second bent portion 173, which bends or curves frontward from a lower end of the linear portion 172. The second bent portions 173 are located upstream with respect to the first bent portions 167 along the conveying direction.

<Reference Guide>

The duplex conveyer 13 includes, as shown in FIGS. 6A-6C, a reference guide 181. The reference guide 181 is located leftward with respect to the first inverting conveyer roller pair 81 and spreads in the vertical direction and in the front-rear direction horizontally. A frontward end of the reference guide 181 is located downstream, i.e., frontward, with respect to the first inverting conveyer roller pair 81 in the conveying direction.

<Directing Guide>

At a position upstream with respect to the reference guide 181 in the conveying direction, arranged is a directing guide 182. The directing guide 182 includes a guiding surface 183 that extends in the vertical direction, and opposing surfaces 184, 185, which extend rightward from an upper end and a lower end of the guiding surface 183 to face each other vertically. The directing guide 182 is open inward at a widthwise inner end and closed at the guiding surface 183 at the widthwise outer end.

The guiding surface 183 extends from a position downstream with respect to the second bent portions 173 of the second ribs 171 in the conveying direction and a position leftward farther from the widthwise center than the reference guide 181 obliquely front-rightward and bend frontward to guide the sheet toward the reference guide. At a frontward end position on the guiding surface 183, formed is a bulge 186, which protrudes rightward in a shape of a hemisphere in a vertical view. A rightward end of the bulge 186 is located at a same widthwise position as a rightward surface of the reference guide 181. In other words, the rightward end of the bulge 186 aligns with the rightward surface of the reference guide 181.

<Correction of the Sheet Position>

The sheet S conveyed toward the duplex conveyer 13 is conveyed in the inverting conveyer path 78 and directed to the curved section 78R, which is between the outer guide 162 and the inner guide 163 of the curve guide 161. The sheet S may proceed along the outer guide 162; however, as the sheet S proceeds further, a midst area of the sheet S with regard to the conveying direction may separate from the outer guide 162. The sheet S separating from the outer guide 162 may contact the second bent portions 173 of the second ribs 171, and a rightward part of the sheet S may be subjected to conveying resistance from the second bent portions 173. Due to the conveying resistance, a conveying speed may be reduced at the rightward part of the sheet S, and the rightward part of the sheet S may lag behind a leftward part. Therefore, a leading edge of the sheet S may incline in such an orientation that the leftward part may precede the rightward part. As the sheet S proceeds further, the sheet S may contact the first bent portions 167 of the first ribs 164, and the leftward part of the sheet S may be subjected to conveying resistance from the first bent portions 167. Therefore, the leading edge of the sheet S may be restrained from inclining largely.

Thereafter, as shown in FIG. 6A, the sheet S may enter the position between the driving rollers 83 and the driven rollers 84 to be caught in the first inverting conveyer roller pair 81. While the first inverting conveyer roller pair 81 is located at the leftward position with respect to the widthwise center, the leftward part of the sheet S caught in the first inverting conveyer roller pair 81 may be thrusted, and the sheet S may incline further so that the leftward part may precede the rightward part. Thereafter, as shown in FIG. 6B, the sideward edge of the sheet S on the left may contact the bulge 186 in the directing guide 182. Meanwhile, the shaft of the driven roller 84 inclines front-rightward and rear-leftward so that the rightward end of the shaft is closer to the front and the leftward end of the shaft is farther from the front. Therefore, the sheet S may be subjected to a conveying force to shift the sheet S leftward from the driven roller 84 and turn centering around a contact point with the bulge 186 so that the leading edge may tend closer to the reference guide 181.

Finally, as shown in FIG. 6C, the sideward edge of the sheet S on the left may align along the rightward surface of the reference guide 181, and the sheet S may be regulated from turning further leftward. Thus, the sheet S may be placed at the correct widthwise position, and an angle of the sheet S with respect to the conveying direction may be corrected so that the widthwise edges of the sheet S may align with the front-rear direction.

<Benefits>

As described above, the sheet S may be directed in the curve guide 161 along the outer guide 162. While the curve guide 161 is formed to have the curvature which is constant throughout the width, that is, the length along the curvature is equal throughout the width of the curve guide 161 regardless of the widthwise position, the sheet S may reach a predetermined portion in the curve guide 161 substantially at the same time. In other words, the timing for the sheet S to reach the predetermined portion in the curve guide 161 may not be different but the same within the width.

As the sheet S is conveyed in the curve guide 161, the midst part of the sheet S along the conveying direction may separate from the outer guide 162. Meanwhile, the inner guide 163 has the second ribs 171 including the second bent portions 173 at the rightward positions, which is on the side opposite of the reference guide 181 across the widthwise center. Therefore, the midst part of the sheet S separating from the outer guide 162 may contact the second bent portions 173, and frictional resistance may be applied from the second bent portions 173 to the sheet S. Accordingly, the leading edge of the sheet S may incline rightward so that the leftward part of the sheet may precede the rightward part, and the leading edge of the sheet S may be oriented at a direction away from the reference guide 181.

Meanwhile, the driven roller 84 in the first inverting conveyer roller pair 81 being the oblique conveyer roller may apply the conveying force to the sheet S; therefore, the sheet S may be turned efficiently so that the sideward edge of the sheet S which is on the side toward the reference guide 181, i.e., on the left, may approach and contact the bulge 186 promptly. Accordingly, the leading edge of the sheet S may approach the reference guide 181 smoothly, and the sheet S may align with the reference guide 181 efficiently so that the sheet S may be set at the correct widthwise position preferably.

<More Examples>

Although an example of carrying out the invention have been described, those skilled in the art will appreciate that there are numerous variations and permutations of the image forming apparatus that fall within the spirit and scope of the disclosure as set forth in the appended claims.

For example, as shown in FIG. 7, the second ribs 171 may be formed to be thicker in the widthwise direction than the first ribs 164. With the thicker second ribs 171, the conveying resistance to be applied from the second ribs 171 to the rightward part of the sheet S may be increased to be greater than the conveying resistance to be applied from the second ribs 171 with the thickness equal to the first ribs 164 and even greater than the conveying resistance to be applied to the rightward part of the sheet S from the first ribs 164.

For another example, as shown in FIG. 8, a part 174 of each second rib 171 that includes the second bent portion 173 may be configured to be separable so that an upstream end of the part 174 in the conveying direction may be swingable about a swing axis 175 extending in the widthwise direction. With the swingable part 174, when, for example, a thicker sheet S with a certain extent of rigidity is conveyed in the curve guide 161, the swingable part 174 may be moved by the sheet S to swing, and the conveying resistance to be applied to the sheet S may be absorbed and restrained from increasing excessively.

It is to be understood that the subject matter defined in the appended claims is not necessarily limited to the specific features or act described above. Rather, the specific features and acts described above are disclosed as example forms of implementing the claims.

What is claimed is:

1. An image forming apparatus, comprising:

a reference guide arranged on one side in a widthwise direction with respect to a widthwise center in a sheet conveyer path, the widthwise direction being orthogonal to a conveying direction to convey a sheet in the sheet conveyer path, the reference guide being configured to regulate a position of the sheet in the widthwise direction;

an oblique conveyer roller configured to apply a conveying force acting in a direction toward downstream along the conveying direction and toward the reference guide to the sheet; and a curve guide arranged upstream with respect to the oblique conveyer roller along the conveying direction, the curve guide forming a curve, along which the sheet is curved and guided, the curve guide comprising:

an inner guide forming an inner side of the curve; and an outer guide forming an outer side of the curve, the outer guide having a constant curvature throughout a width regardless of a widthwise position therein, wherein the inner guide comprises a protrusive portion protruding toward the outer guide at a position on the other side in the widthwise direction with respect to the widthwise center.

2. The image forming apparatus according to claim 1, wherein the inner guide comprises:

a first rib arranged on the one side in the widthwise direction with respect to the widthwise center, the first rib protruding toward the outer guide and extending along the conveying direction, the first rib including a first bent portion; and a second rib arranged on the other side in the widthwise direction with respect to the widthwise center, the second rib protruding toward the outer guide and extending along the conveying direction, the second rib including a second bent portion; and wherein the second bent portion is located upstream with respect to the first bent portion along the conveying direction.

3. The image forming apparatus according to claim 2, further comprising:

a directing guide arranged upstream with respect to the oblique conveyer roller along the conveying direction, the directing guide having a guiding surface, the guiding surface being configured to guide the sheet from a position farther from the widthwise center than the reference guide in the widthwise direction toward the reference guide, and opposing surfaces, the opposing surfaces facing each other along a direction orthogonal to the conveying direction and to the widthwise direction, the directing guide being open inward in the widthwise direction, wherein the second bent portion is arranged at a position different from an upstream end of the directing guide in the conveying direction.

4. The image forming apparatus according to claim 2, wherein a thickness of the second rib in the widthwise direction is greater than a thickness of the first rib in the widthwise direction.

5. The image forming apparatus according to claim 1, wherein the protrusive portion includes the second bent portion.

6. The image forming apparatus according to claim 1, wherein the protrusive portion is swingable at an upstream end portion thereof on an upstream side in the conveying direction.

7. The image forming apparatus according to claim 1, wherein the reference guide is arranged to extend in a horizontal direction; and wherein the curve guide curves between a section extending in the vertical direction and a section extending in the horizontal direction in the sheet conveyer path.

* * * * *